US011163247B2

(12) United States Patent
Kedem et al.

(10) Patent No.: US 11,163,247 B2
(45) Date of Patent: Nov. 2, 2021

(54) BLANKET SERVICING UTILIZING ROTATABLY MOUNTED ENDLESS CLEANING SURFACES

(71) Applicant: Hewlett-Packard Development Company, L.P., Spring, TX (US)

(72) Inventors: Amir Kedem, Ness Ziona (IL); Michael Kokotov, Ness Ziona (IL); Alex Feygelman, Ness Ziona (IL); Guy Nesher, Ness Ziona (IL); Nadav Shalem, Ness Ziona (IL); Michael Vinokur, Ness Ziona (IL)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/051,091

(22) PCT Filed: Jul. 31, 2018

(86) PCT No.: PCT/US2018/044591
§ 371 (c)(1),
(2) Date: Oct. 27, 2020

(87) PCT Pub. No.: WO2020/027803
PCT Pub. Date: Feb. 6, 2020

(65) Prior Publication Data

US 2021/0232069 A1 Jul. 29, 2021

(51) Int. Cl.
*G03G 15/16* (2006.01)
*B08B 1/04* (2006.01)

(52) U.S. Cl.
CPC ..... *G03G 15/161* (2013.01); *B08B 1/04* (2013.01); *G03G 2215/1652* (2013.01)

(58) Field of Classification Search
CPC ..... G03G 15/161; G03G 2215/1647; G03G 2215/1657; G03G 2215/1661
USPC ..... 399/71, 101
See application file for complete search history.

(56) References Cited

U.S. PATENT DOCUMENTS

| | | | |
|---|---|---|---|
| 4,027,964 | A | 6/1977 | Fantuzzo |
| 4,066,017 | A | 1/1978 | Garcowski |
| 4,311,094 | A | 1/1982 | Ellison |
| 5,503,788 | A | 4/1996 | Lazareck |
| 5,678,134 | A | 10/1997 | Miki |
| 6,047,758 | A | 4/2000 | Kuramoto |
| 6,487,389 | B2 | 11/2002 | Jia |

(Continued)

FOREIGN PATENT DOCUMENTS

| | | | |
|---|---|---|---|
| CN | 206012023 | U | 3/2017 |
| EP | 0979171 | B1 | 5/2002 |
| JP | H4126582 | A | 4/1992 |

*Primary Examiner* — William J Royer
(74) *Attorney, Agent, or Firm* — HP Inc. Patent Department

(57) ABSTRACT

In an example of the disclosure, a blanket servicing system includes a rotatably mounted endless cleaning surface and a scraper. The endless cleaning surface is to have a first engagement with a blanket to obtain a layer of thermoplastic print agent from the blanket. The endless cleaning surface is to have a second engagement with the blanket to receive residue from the blanket onto the layer of thermoplastic print agent. The scraper is to scrape the endless cleaning surface to transfer the residue from the endless cleaning surface to a collection element.

15 Claims, 9 Drawing Sheets

(56) References Cited

U.S. PATENT DOCUMENTS

| | | | | |
|---|---|---|---|---|
| 8,699,907 | B2 * | 4/2014 | Zhang et al. | G03G 15/161 399/71 |
| 2007/0012210 | A1 | 1/2007 | Lundin | |
| 2012/0103217 | A1 | 5/2012 | Stowe | |
| 2014/0013980 | A1 | 1/2014 | Veres | |

* cited by examiner

BLANKET SERVICING UTILIZING ROTATABLY MOUNTED ENDLESS CLEANING SURFACES

BACKGROUND

A printer may apply print agents to a paper or another substrate. One example of a printer is a Liquid Electro-Photographic ("LEP") printer, which may be used to print using a fluid print agent such as an electrostatic printing fluid. Such electrostatic printing fluid includes electrostatically charged or chargeable particles (for example, resin or toner particles which may be colorant particles) dispersed or suspended in a carrier fluid).

DRAWINGS

DETAILED DESCRIPTION

Figure 1:
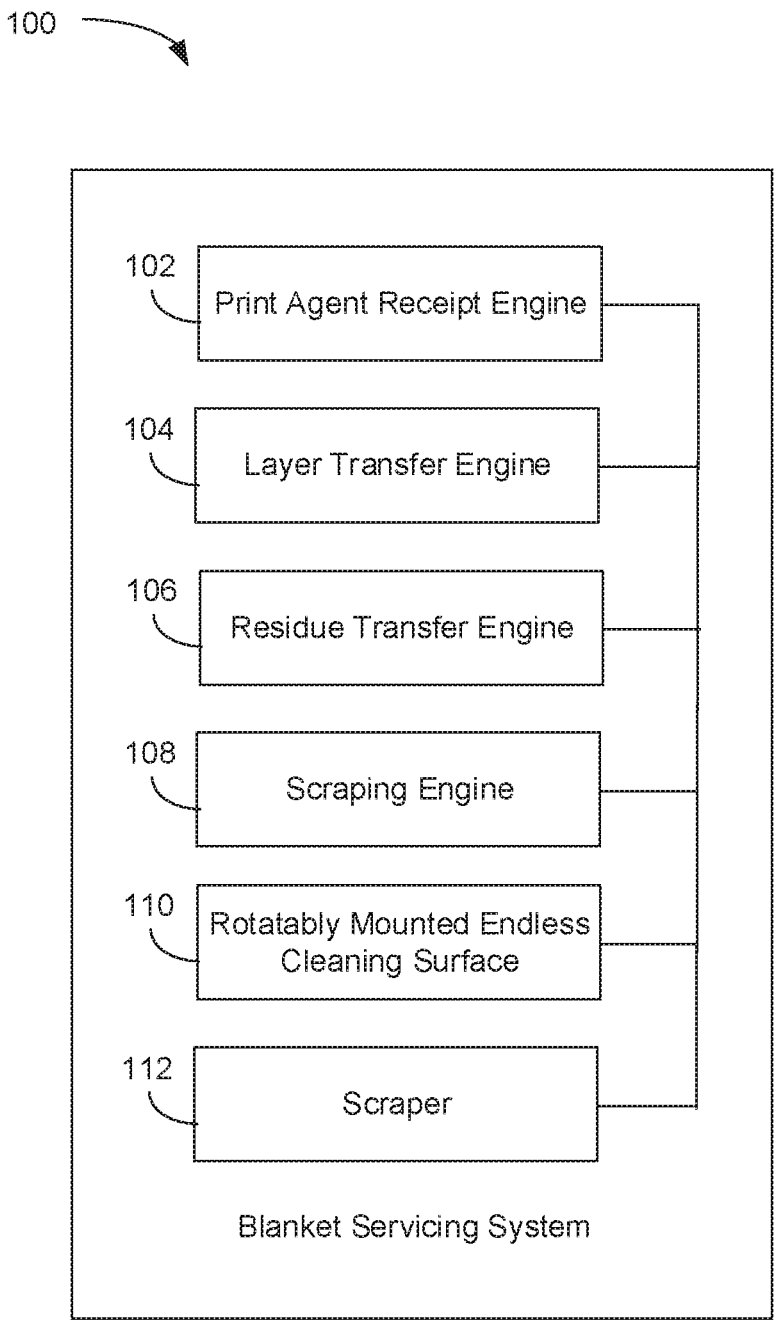
FIG. 1 is a block diagram depicting an example of a blanket servicing system.

In an example of LEP printing, a printer system may form an image on a print substrate by placing an electrostatic charge on a photoconductive element, and then utilizing a laser scanning unit to apply an electrostatic pattern of the desired image on the photoconductive element to selectively discharge the photoconductive element. The selective discharging forms a latent electrostatic image on the photoconductive element. The printer system includes a development station to develop the latent image into a visible image by applying a thin layer of electrostatic print fluid (which may be generally referred to as "LEP print fluid", or "electronic print fluid", "LEP ink", or "electronic ink" in some examples) to the patterned photoconductive element. Charged particles (sometimes referred to herein as "print fluid particles" or "colorant particles") in the LEP print fluid adhere to the electrostatic pattern on the photoconductive element to form a print fluid image. In examples, the print fluid image, including colorant particles and carrier fluid, is transferred utilizing a combination of heat and pressure from the photoconductive element to an intermediate transfer member (referred herein as a "blanket") attached to a rotatable blanket drum. The blanket is heated until carrier fluid evaporates and colorant particles melt, and a resulting molten film representative of the image is then applied to the surface of the print substrate via pressure and tackiness. In examples the blanket that is attached to the blanket drum is a consumable or replaceable blanket.

For printing with colored print fluids, the printer system may include a separate development station for each of the various colored print fluids. There are typically two process methods for transferring a colored image from the photoconductive element to the substrate. One method is a multi-shot process method in which the process described in the preceding paragraph is repeated a distinct printing separation for each color, and each color is transferred sequentially in distinct passes from the blanket to the substrate until a full image is achieved. With multi-shot printing, for each separation a molten film (with one color) is applied to the surface of the print substrate. A second method is a one-shot process in which multiple color separations are acquired on the blanket via multiple applications (each with one color) from the photoconductive element to the blanket, and then the acquired color separations are transferred in one pass as a molten film from the blanket to the substrate.

A significant challenge in LEP printing is that the blanket held by the blanket drum is prone to contamination. After a number of transfers have taken place from the photoconductive element to the blanket, and subsequent transfers from the blanket to a substrate, contaminants such as print agent residue, dust, machine oil and the like will build up on the surface of the blanket. The accumulation of such contaminants on the blanket can greatly reduce print quality. Using a cleaning roller or belt to clean a blanket can reduce the amount of contaminants, but the blanket surface may be a non-uniform surface after such cleaning due to contaminants not accumulating evenly on the cleaning roller or belt. In certain situations, if the print agent uniformity on the cleaning roller or belt accumulates to 10 μm, deformations may exist on the next print agent transfers from photoconductive element to blanket, and blanket to substrate, such that print quality of production jobs is impacted. In certain situations, if the print agent uniformity on the cleaning roller or belt accumulates to 50 μm, print quality of production jobs can be severely impacted and the blanket may be deformed by the cleaning process to an extent to compel replacement.

To address these issues, various examples described in more detail below provide a system and a method that enables servicing of the blanket to remove accumulated contaminants. In an example of the disclosure, a blanket is to receive thermoplastic print agent from a photoconductive element. A layer of the thermoplastic print agent is to be transferred from the blanket to a rotatably mounted endless cleaning surface. Residue from the blanket is to be transferred to the layer of thermoplastic print agent at the endless cleaning surface. The endless cleaning surface is to be scraped to transfer the residue to a collection element.

In examples, the endless cleaning surface utilized to receive the layer of thermostatic print agent and to collect the residue from the blanket may be a surface of a roller or a surface of a belt. In an example, a heater may be utilized to heat the endless cleaning surface, as it is engaged by the scraper. In an example, the heater may heat the endless cleaning surface as it receives the layer of thermoplastic print agent from the blanket. In an example, the layer of thermoplastic print agent obtained by the endless cleaning surface includes thermoplastic print agent received by the blanket from a photoconductive element and is thermoplastic print agent that has not encountered a substrate.

In an example, a biasing device may be utilized to bias the scraper against the endless cleaning surface. In a particular example, the biasing may be implemented with force control. A sensor may be utilized to record a variance in thickness and/or density of the endless cleaning surface. A force with which the scraper is to be biased towards the endless cleaning surface can be determined in view of the observed variance. The biasing device can then be adjusted to exert the determined biasing force towards the endless cleaning surface.

In an example, the scraper may be moved along a linear track to traverse and engage a width of the endless cleaning surface. In an example, the scraper may do the scraping of the endless cleaning surface concurrent with the endless cleaning surface cleaning the blanket. In a particular example, the scraper may scrape the endless cleaning surface, the endless cleaning surface cleaning the blanket, and the blanket being utilized in a printing operation may all occur concurrently.

In an example, the scraper may scrape the residue from the blanket into a collection element that is a collection tray. In a particular example, the collection element may include a heater to heat the residue to a melting point within the collection element, and a mold to collect melted residue and allow the melted residue to cool to transform into a hardened state. In another particular example, the collection element may be situated at a printer above an impression drum, and a screw may engage with the residue in the collection tray to chop the residue into pieces and cause the pieces to accumulate into a second collection tray that is not situated above the impression drum.

In this manner the disclosed apparatus and method enables use of a rotatably mounted endless cleaning surface for blanket cleaning by leveling the surface of the cleaning roller after the cleaning roller accumulates blanket residues. The disclosed method and system enables frequent, or even continuous, blanket cleaning with minimal consumables usage and without interruption to the printing process or costumer workflow. The ability to effectively utilize an endless cleaning surface to evacuate large amounts of print agent and substrate residues from the blanket is highly advantageous for printing on structured substrates such as canvas and wall paper.

Users and providers of LEP printer systems and other printer systems will appreciate the improvements in print quality, the ability to clean the blanket and level the cleaning roller frequently and without disrupting the printing process, longer blanket life, and ease in collecting accumulated blanket residue that are afforded by utilization of the disclosed examples. Installations and utilization of LEP printers that include the disclosed apparatus and methods should thereby be enhanced.

Figure 2:
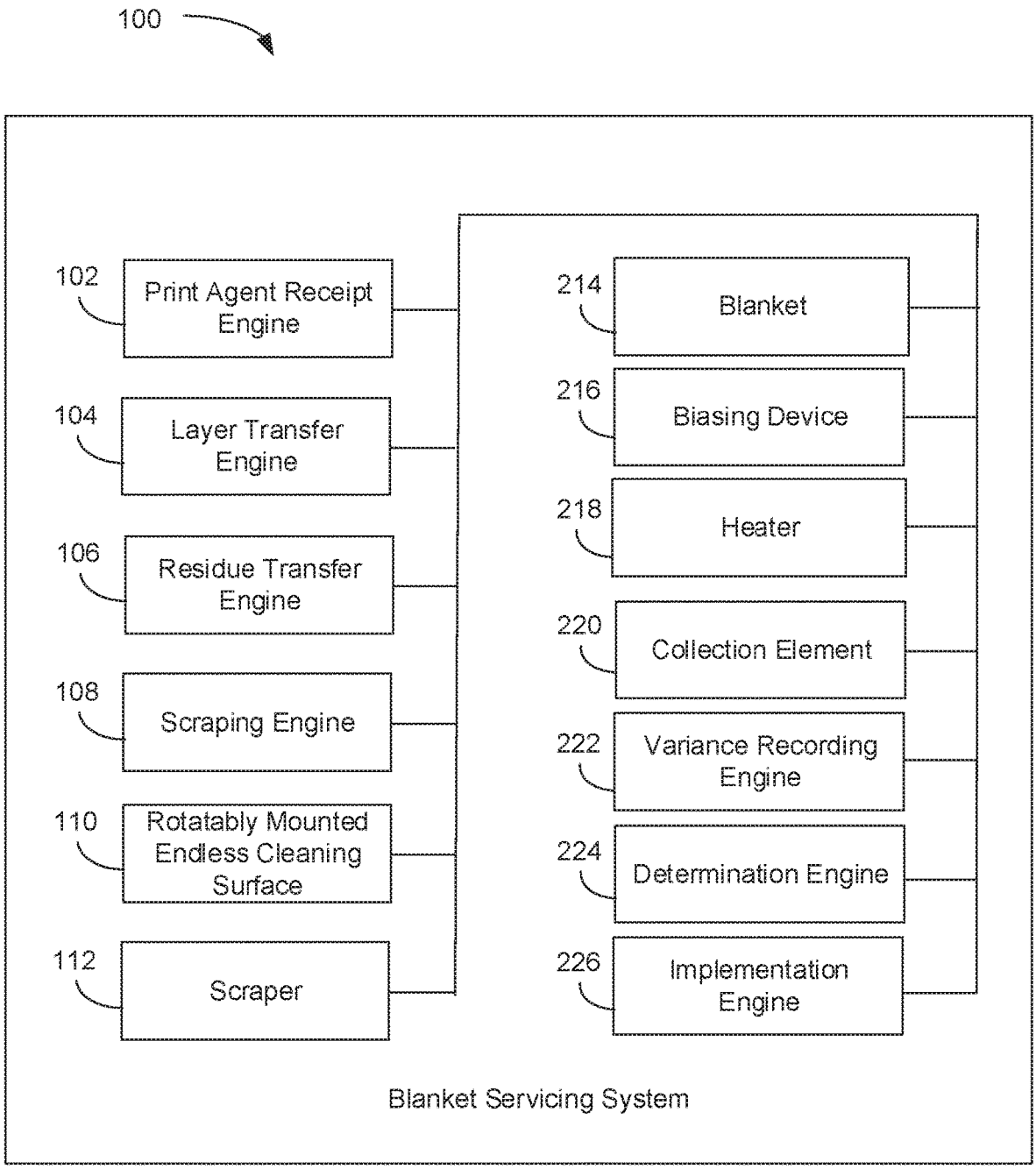
FIG. 2 is block diagram depicting another example of a blanket servicing system.

FIGS. 1-2 depict examples of physical and logical components for implementing various examples. In FIGS. 1-2 various components are identified as engines 102, 104, 106, 222, 224, and 226. In describing engines 102, 104, 106, 222, 224, and 226 focus is on each engine's designated function. However, the term engine, as used herein, refers generally to hardware and/or programming to perform a designated function. As is illustrated later with respect to FIG. 3, the hardware of each engine, for example, may include one or both of a processor and a memory, while the programming may be code stored on that memory and executable by the processor to perform the designated function.

FIG. 1 illustrates an example of a system 100 for servicing blankets utilizing thermoplastic print agent. In this example, system 100 includes a print agent receipt engine 102, a layer transfer engine 104, a residue transfer engine 106, a scraping engine 108, a rotatably mounted endless cleaning surface 110 and a scraper 112. In performing their respective functions, print agent receipt engine 102, layer transfer engine 104, residue transfer engine 106, and scraper engine 108 may access a data repository, e.g., a memory accessible to system 100 that can be used to store and retrieve data.

In the example of FIG. 1, print agent receipt engine 102 represents generally a combination of hardware and programming to receive a thermoplastic print agent at a blanket from a photoconductor element. As used herein "thermoplastic" refers generally to a polymer that becomes pliable or moldable above a specific temperature and solidifies upon cooling. Polyethylene, polypropylene, polyvinyl chloride, polystyrene, polybenzimidazole, acrylic, nylon and Teflon are examples of thermoplastics. As used herein a "photoconductor" refers generally to a material or a device that becomes more electrically conductive as it is exposed to electromagnetic radiation (e.g., visible light, ultraviolet light, infrared light, or gamma radiation). As used herein, a "blanket" refers generally to an intermediate transfer member that can receive print agent from a photoconductor and in turn transfer some or all of the print agent to a substrate. In certain examples, a photoconductor may be attached to a rotatably mounted drum and the blanket may be attached to another rotatably mounted drum, wherein the drums are arranged such that the photoconductor and the blanket each rotate and abut one another throughout the rotations.

In examples, the thermoplastic print agent is a thermoplastic ink. As used herein, the term "print agent" refers generally to any material or to any substance that can be applied upon a media by a printer during a printing operation, including but not limited to aqueous inks, solvent inks, UV-curable inks, dye sublimation inks, latex inks, liquid electro-photographic inks, liquid or solid toners, powders, primers, and overprint materials (such as a varnish). As used herein, an "ink" refers generally to any fluid that is to be applied to a substrate during a printing operation to form an image upon the substrate.

Continuing with the example of FIG. 1, layer transfer engine 104 represents generally a combination of hardware and programming to transfer a layer of the thermoplastic print agent from the blanket to a rotatably mounted endless cleaning surface 110. In certain examples, the blanket may be attached to a rotatably mounted drum and rotatably mounted endless cleaning surface 110 may be attached to another rotatably mounted drum, wherein the drums are arranged such that the blanket and endless cleaning surface 110 each rotate and abut one another as roller surfaces. In certain other examples, endless cleaning surface 110 may be or may be included within a belt, such that endless cleaning surface 110 is a belt surface. In examples, the layer of thermoplastic print agent obtained by endless cleaning surface 110 from the blanket is or includes thermoplastic print agent that was received at the blanket from a photoconductor that had not yet encountered a substrate. Such thermoplastic print agent may be referred to as a layer of "clean thermoplastic print agent" in that the thermoplastic print agent had not been used to produce an image upon a substrate.

Residue transfer engine 106 represents generally a combination of hardware and programming to transfer residue from the blanket to the layer of thermoplastic print agent at endless cleaning surface 110. As used herein, "residue" on a blanket refers generally to a substance that remains at the blanket after the blanket has been used to transfer an inked image to a substrate. In examples, the residue may include leftover print agent, paper dust, varnish, colorant, and/or resin.

Continuing with the example of FIG. 1, scraping engine 108 represents generally a combination of hardware and programming to cause a scraper 112 to scrape endless cleaning surface 110 to transfer the residue to a collection element. As used herein, a "scraper" refers generally to any device with an edge that is to be used to remove a material from a surface. In examples, scraper 112 may be or include, but is not limited to, any of a blade (e.g., a straight blade, a curved blade, a doctor blade, an angled blade, etc.), a, lathe, and a gouge. In example, scraper 112 may be a fixed blade or a movable blade. In examples, scraper 112 may include a blade of carbon steel, stainless steel, tool steel, alloy steel, cobalt alloy, titanium alloy, ceramic, obsidian, plastic, and/or any other durable material.

In a particular example, scraper 112 may be a scraper that has a convex surface and is movable along a linear track in a horizontal plane. In some circumstances, a scraper with a convex shape will have enhanced rigidity relative to a flat scraper. In examples, a rounded portion of the convex scraper is to engage the endless cleaning surface. In many circumstances utilizing a scraper with a small surface area relative to the endless cleaning surface (e.g., traversing such scraper along a horizontal linear track to engage a width of the endless cleaning surface) will require less torque and will better handle bumps of residue (with less scraper bounce) than a system that utilizes a large fixed blade.

In examples, scraper 112 is to scrape endless cleaning surface 110 concurrent with endless cleaning surface 110 cleaning the blanket. In certain examples, scraper 112 is to scrape endless cleaning surface 110 concurrent with the blanket being utilized in a printing operation (e.g., the blanket receiving print agent from a photoconductor or the blanket transferring print agent to a substrate). These concurrent scraping, cleaning, and printing operations are made possible by the utilization of the endless cleaning surface 110 in conjunction with an endless blanket (a blanket that is, or is mounted to, a drum, roller or belt). In a particular example, the endless cleaning surface is positioned abutting the blanket at a point in the blanket rotation that is after a blanket-to-substrate nip and before a blanket-to-photoconductor nip.

FIG. 2 illustrates another example of system 100 for blanket servicing. As in FIG. 1, system 100 includes a print agent receipt engine 102, a layer transfer engine 104, a residue transfer engine 106, a scraping engine 108, a rotatably mounted endless cleaning surface 110 and a scraper 112. System 100 of FIG. 2 additionally includes a blanket 214, a biasing device 216, a heater 218, a collection element 220, a variance recording engine 222, a determination engine 224, and an implementation engine 226. In performing their respective functions, variance recording engine 222, determination engine 224, and implementation engine 226 may access a data repository, e.g., a memory accessible to system 100 that can be used to store and retrieve data.

In the example of FIG. 2, blanket 214 is to receive a thermoplastic print agent from a photoconductor element. Rotatably mounted endless cleaning surface 110 is to receive a layer of thermoplastic print agent from blanket 214. The endless cleaning surface 110 is to engage with blanket 214 to transfer residue from blanket 214 to the layer of thermoplastic print agent on endless cleaning surface 110. Scraper 112 is to engage with endless cleaning surface 110 and transfer the residue from endless cleaning surface 110 to a collection element 220.

In certain examples, system 100 includes a heater 218 to heat endless cleaning surface 110. In such examples, scraper 112 is to engage with endless cleaning surface 110 while endless cleaning surface 110 is being heated. Heating the residue which has accumulated on endless cleaning surface 110 to a softening point can assist in the removal process as smoother surface finish on the endless cleaning surface 110 is formed and scattering of debris is avoided. In one example, the endless cleaning surface may be heated to approximately 100 C+−10 C at the time scraper engages the endless cleaning surface.

Continuing at FIG. 2, in certain examples, heater 218 may also be utilized to heat endless cleaning surface 110 as the endless cleaning surface 110 receives the layer of thermoplastic print agent from blanket 214. In these examples, heating the layer of thermoplastic print agent to be transferred to blanket 214 to a softening point can assist in the transfer process. In other examples, the scraper 112 may accomplish the scraping of endless cleaning surface 110 without a heater or heating of the endless cleaning surface.

In other examples, collection element 220 may be, or may include, a stationary tray, a movable tray, a heated tray, a heated tray with a removable mold, or any other type of tray for collecting residue that is scraped from endless cleaning surface 110 by scraper 112.

Continuing at FIG. 2, system 100 includes a biasing device 216 to bias scraper 112 against endless cleaning surface 110. In examples, biasing device 216 may be, or may include, a spring, such that scraper 112 is spring-loaded to bias towards endless cleaning surface 110. In examples, biasing device 216 may be a compression spring. In other examples, the biasing device may be a tension spring or any other type of spring or any other device that causes scraper 112 to bias towards endless cleaning surface 110.

In certain examples, system 100 may include a variance recording engine 222, a determination engine 224, and an implementation engine 226. Variance recording engine 222 is to utilize a sensor to record a variance in thickness and/or density of endless cleaning surface 110. In examples, variance recording engine 222 may trigger a cleaning of endless cleaning surface 110 upon determining that a predetermined level of residue buildup, or a predetermined amount nature of residue buildup (e.g., identified peaks and valleys). Determination engine 224 is to determine a force with which scraper 112 is to be biased towards endless cleaning surface 110 given the amount or nature of the observed or recorded variance. Implementation engine 226 is to adjust biasing device 216 to exert the biasing force that was determined by determination engine 224 towards endless cleaning surface 110. In examples, system 100 may access or utilize a look-up table in calculating the force with which scraper 112 is to be biased towards endless cleaning surface 110. In examples, the biasing device 216 to be utilized in conjunction with variance recording engine 222, determination engine 224, and implementation engine 226 may be a variable spring or a variable stiffness spring.

In the foregoing discussion of FIGS. 1 and 2, engines 102, 104, 106, 108, 222, 224, and 226 were described as combinations of hardware and programming. Engines 102, 104, 106, 108, 222, 224, and 226 may be implemented in a number of fashions. Looking at FIG. 3 the programming may be processor executable instructions stored on a tangible memory resource 330 and the hardware may include a processing resource 340 for executing those instructions.

Thus, memory resource 330 can be said to store program instructions that when executed by processing resource 340 implement system 100 of FIGS. 1-2.

Memory resource 330 represents generally any number of memory components capable of storing instructions that can be executed by processing resource 340. Memory resource 330 is non-transitory in the sense that it does not encompass a transitory signal but instead is made up of a memory component or memory components to store the relevant instructions. Memory resource 330 may be implemented in a single device or distributed across devices. Likewise, processing resource 340 represents any number of processors capable of executing instructions stored by memory resource 330. Processing resource 340 may be integrated in a single device or distributed across devices. Further, memory resource 330 may be fully or partially integrated in the same device as processing resource 340, or it may be separate but accessible to that device and processing resource 340.

In one example, the program instructions can be part of an installation package that when installed can be executed by processing resource 340 to implement system 100. In this case, memory resource 330 may be a portable medium such as a CD, DVD, or flash drive or a memory maintained by a server from which the installation package can be downloaded and installed. In another example, the program instructions may be part of an application or applications already installed. Here, memory resource 330 can include integrated memory such as a hard drive, solid state drive, or the like.

Figure 3:
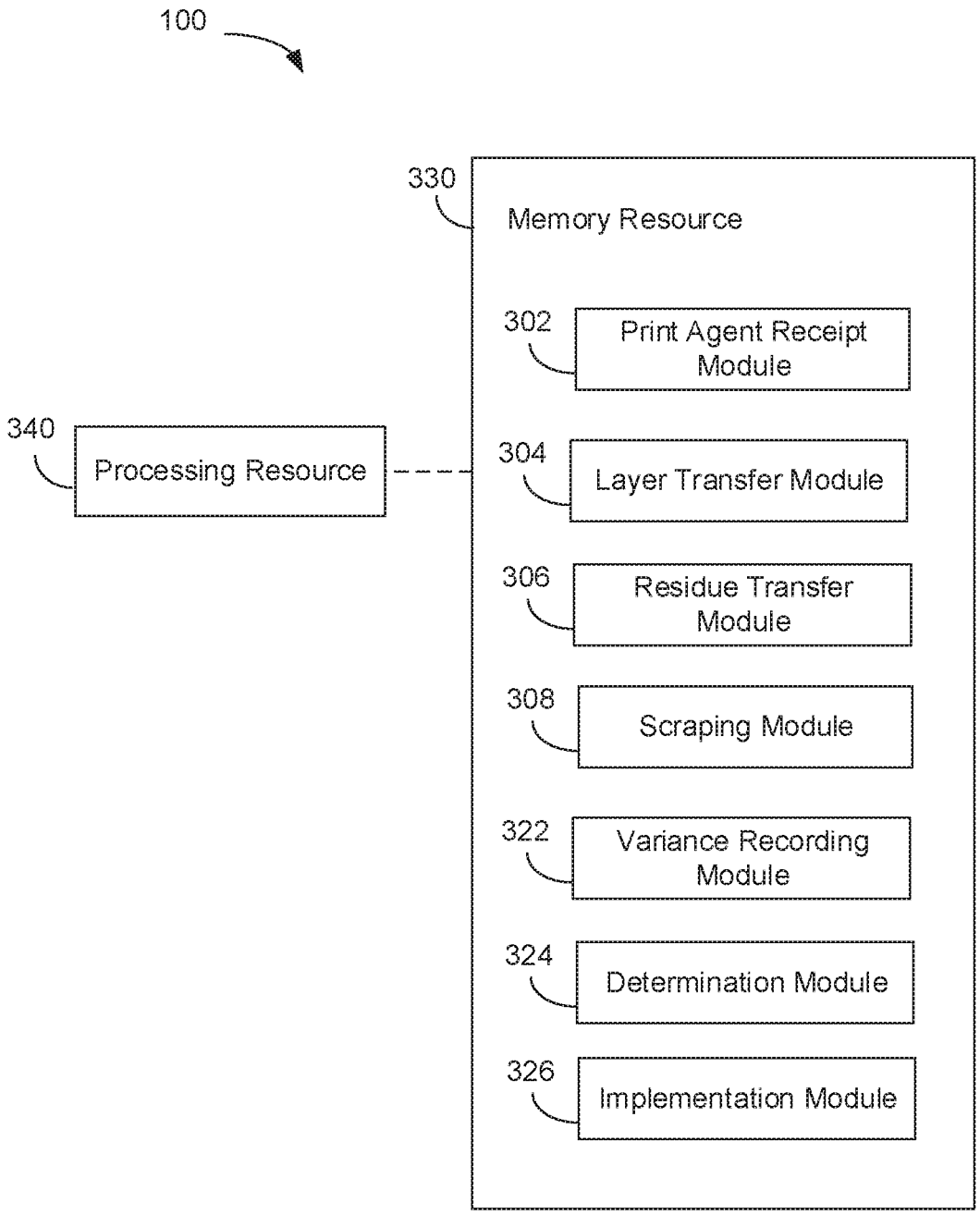
FIG. 3 is a block diagram depicting a memory resource and a processing resource to implement an example of a method for servicing a blanket utilizing thermoplastic print agent.

In FIG. 3, the executable program instructions stored in memory resource 330 are depicted as print agent receipt module 302, layer transfer module 304, residual transfer module 306, scraping module 308, variance recording module 322, determination module 324 and implementation module 326. Print agent receipt module 302 represents program instructions that when executed by processing resource 340 may perform any of the functionalities described above in relation to print agent receipt engine 102 of FIG. 1. Layer transfer module 304 represents program instructions that when executed by processing resource 340 may perform any of the functionalities described above in relation to layer transfer engine 104 of FIG. 1. Residue transfer module 306 represents program instructions that when executed by processing resource 340 may perform any of the functionalities described above in relation to residue transfer engine 106 of FIG. 1. Scraping module 308 represents program instructions that when executed by processing resource 340 may perform any of the functionalities described above in relation to scraping engine 108 of FIG. 1. Variance recording module 322 represents program instructions that when executed by processing resource 340 may perform any of the functionalities described above in relation to variance recording engine 222 of FIG. 2. Determination module 324 represents program instructions that when executed by processing resource 340 may perform any of the functionalities described above in relation to determination engine 224 of FIG. 2. Implementation module 326 represents program instructions that when executed by processing resource 340 may perform any of the functionalities described above in relation to implementation engine 226 of FIG. 2.

Figure 4:
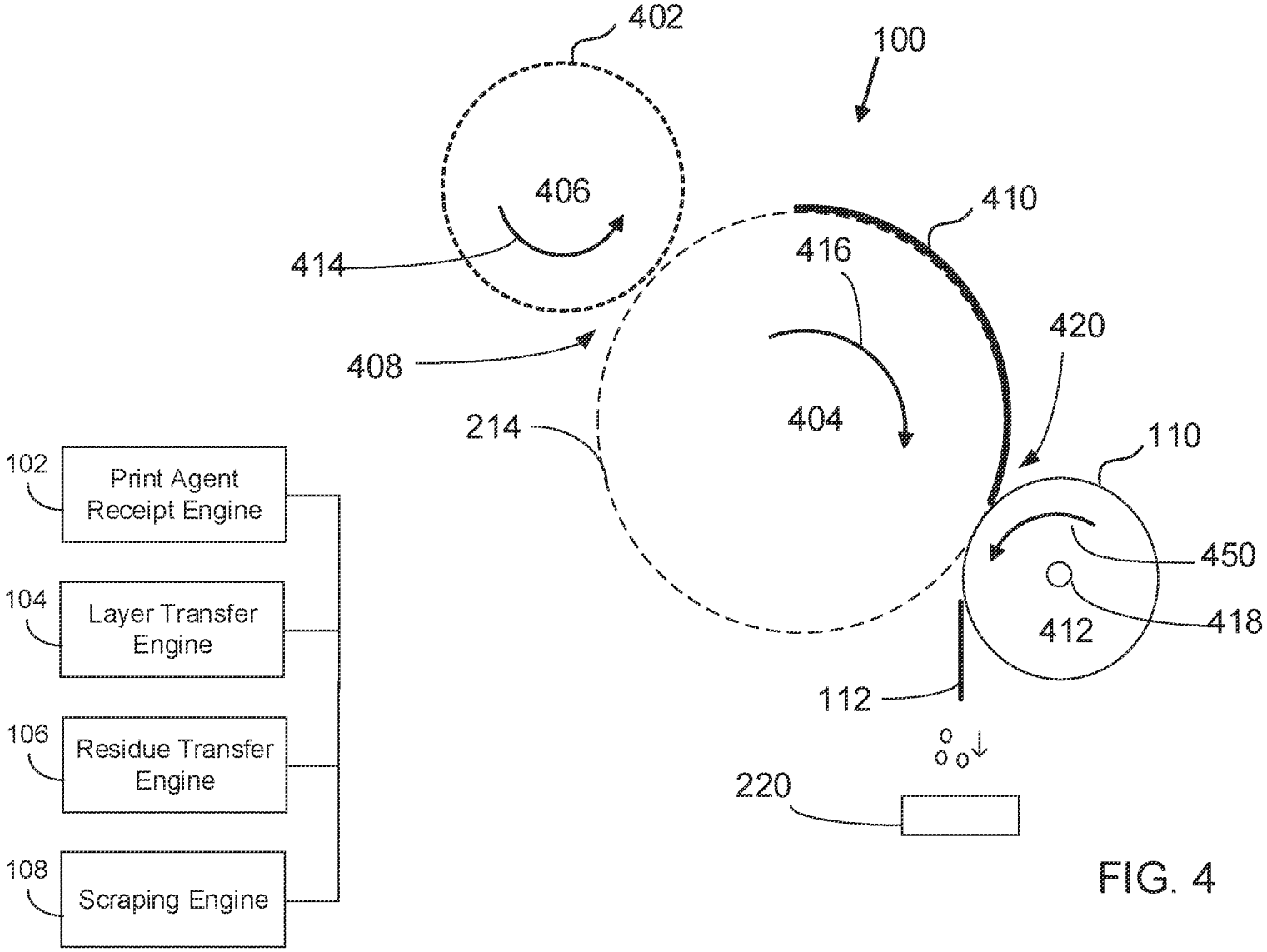
FIG. 4 is a simple schematic diagram that illustrates an example of a blanket servicing system that includes a rotatably mounted endless cleaning surface with a roller surface.

FIG. 4 is a simple schematic diagram that illustrates an example of a blanket servicing system 100. Beginning at FIG. 4, in this example, a blanket 214 is to receive a thermoplastic print agent 410 from a photoconductor element 402. In the example, blanket 214 and photoconductor element 402 have endless surfaces as each is each mounted on a drum (blanket drum 404 and photoconductor element drum 406). A first nip 408 is formed as blanket 214 and photoconductor element 402 rotate in opposite directions (first direction 414 and second direction 416 respectively) in contact with one another.

System 100 includes a rotatably mounted endless cleaning surface 110 to receive thermoplastic print agent 410 from photoconductor element 402. This thermoplastic print agent 410 has not been in contact with a substrate during a printing process. In this example, endless cleaning surface 110 is rotatably mounted and is an endless roller surface as the cleaning surface is wrapped around a cleaning surface drum 412 that is it rotate around a drum axis 418.

Rotatably mounted endless cleaning surface 110 is to receive a layer (which may include all or a portion of thermoplastic print agent 410 that blanket 214 received from photoconductor element 402 from blanket 214 at a second nip 420. Second nip 420 is formed as blanket 214 and endless cleaning surface 110 rotate in opposite directions (first direction 450 and second direction 416 respectively) in contact with one another.

After receipt of the print agent layer, endless cleaning surface 110 is to engage with blanket drum 404 to transfer residue from blanket 214 to the layer of thermoplastic print agent 410 on endless cleaning surface 110. Such transfer may also be referred to as a collection of residue from blanket 214 onto the print agent layer that is at endless cleaning surface 110.

Continuing with the example of FIG. 4, a scraper 112 is to engage with endless cleaning surface 110 and thereby transfer the residue from endless cleaning surface 110 to a tray collection element 220. In examples, scraper 112 is to scrape endless cleaning surface 110 concurrent with endless cleaning surface 110 cleaning blanket 214. In particular examples, scraper 112 is to scrape endless cleaning surface 110 concurrent with blanket 214 being utilized in a printing operation (e.g., receiving print agent from photoconductor element drum 406 and/or transferring print agent to a substrate to form a printed image).

Figure 5:
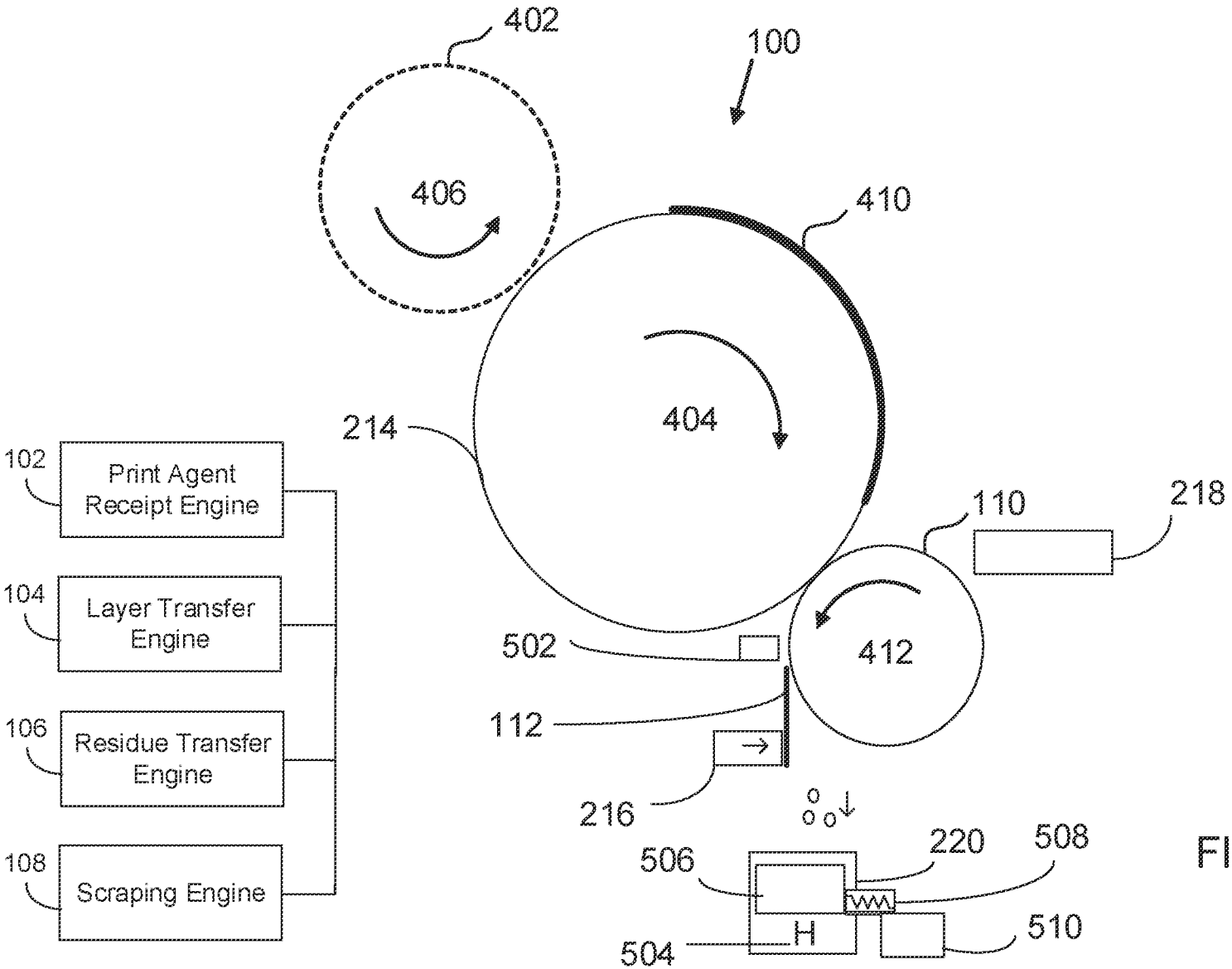
FIG. 5 is a simple schematic diagram that illustrates an example of a blanket servicing system, wherein the system includes a biasing device and a heated collection tray with a heating element.

FIG. 5 is a simple schematic diagram that illustrates an example of a blanket servicing system 100. In this example, system 100 of FIG. 4 also includes a biasing device 216 to bias the scraper 112 against endless cleaning surface 110. In examples, biasing device 216 may be or include any type of spring or coil to cause scraper 112 to bias towards endless cleaning surface 110.

In a particular example, system 100 may utilize a sensor 502 to record a variance in thickness and/or density of the endless cleaning surface 110. In examples, the measured variance in thickness and/or density is a product of build-up of residue (the residue collected from blanket 214) upon endless cleaning surface 110. In this example, system 100 is to determine a force with which scraper 112 is to be biased towards endless cleaning surface 110 in view of the observed variance. System 100 is to then adjust biasing device 216 (e.g., moving biasing device 216 to cause a shortening or lengthening of a spring included within biasing device 216) to exert the determined biasing force towards endless cleaning surface 110.

In this example, system 100 includes a heater 218 to heat endless cleaning surface 110. In this example, scraper 112 is to engage with endless cleaning surface 110 while endless cleaning surface 110 is being heated. In this manner, the residue which accumulated on endless cleaning surface 110 is heated to a softening point that assists in transfer of the residue from endless cleaning surface 110 to a collection element 220. In an example, the endless cleaning surface 110 may be heated to approximately 100 C+−10 C at the time scraper 112 engages endless cleaning surface 110. In certain examples, heater 218 may also be utilized to heat endless cleaning surface 110 as endless cleaning surface 110 receives the layer of thermoplastic print agent 410 from the blanket 214.

Continuing at FIG. 5, in this example of system 100 the collection element 220 includes a collection element heater 504 to heat accumulated solid chips or portions of residue (residue transferred from blanket 214 to endless cleaning surface 110 and then to collection element 220) to a melting point. In this particular example, collection element 220 includes a mold 506 to collect melted residue and allow the melted residue to cool to transform into a hardened state. In an example, the mold 506 may be constructed such that when cooled a user can easily remove the residue as a solid block.

In other examples, the mold 506 may be constructed such that when cooled the residue can be removed from mold 506 by an automatic removal system (e.g., a combination of hardware and software for removing a block of residue from mold 506 with little or no user activity). In a particular example, system 100 may include a second collection tray 510, and a screw conveyor 508 or other transport to engage with the residue in the collection element (first collection tray) 220 to chop the residue into pieces and cause the pieces to accumulate in the second collection tray 510. In one example, screw conveyor 508 may engage with the residue in mold 506 of first collection tray 220 to chop the residue into pieces and cause the pieces to accumulate in the second collection tray 510.

Figure 6:
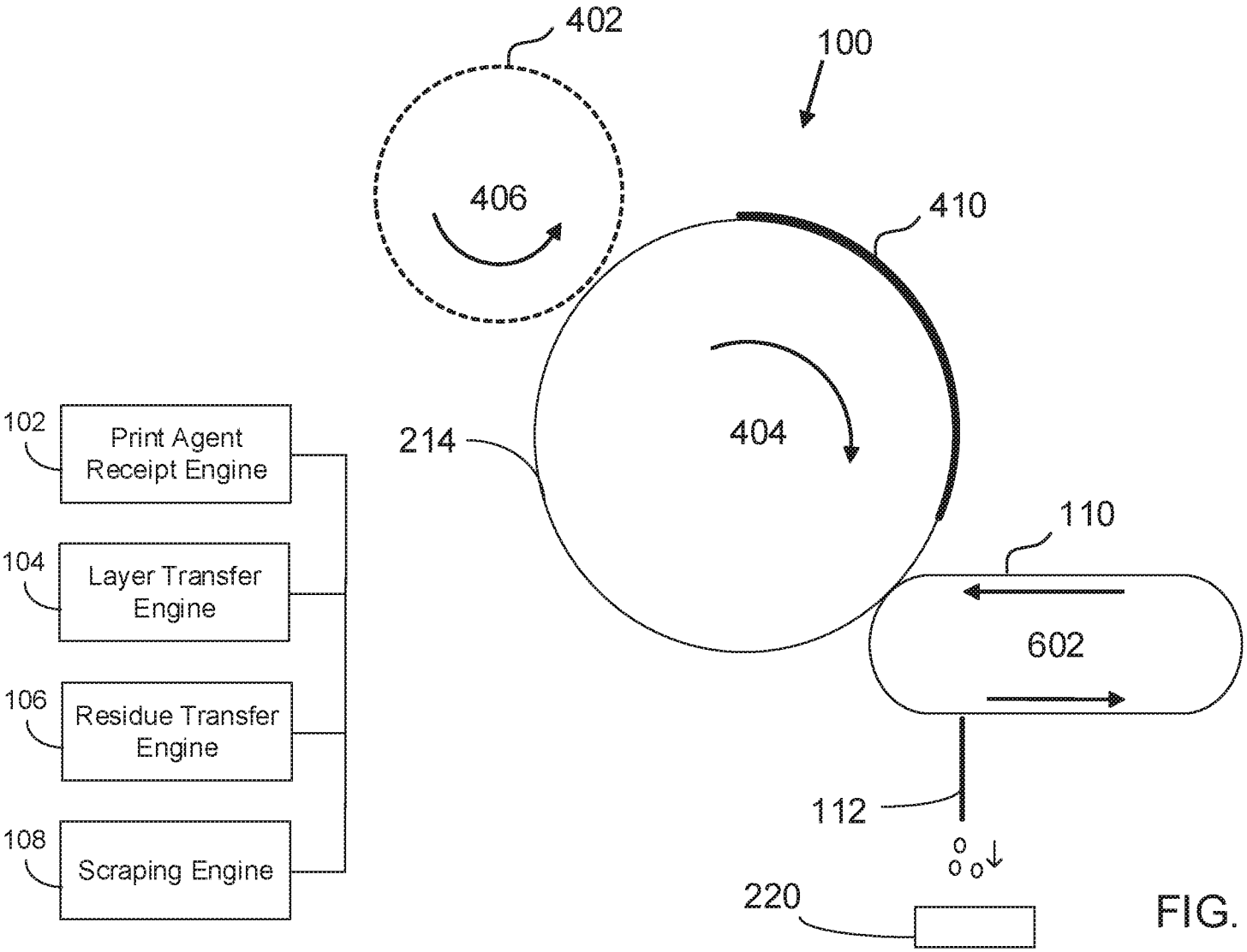
FIG. 6 is a simple schematic diagram that illustrates an example of a blanket servicing system that includes a rotatably mounted endless cleaning surface with a belt surface.

FIG. 6 is a simple schematic diagram that illustrates an example of a blanket servicing system 100. In this example, a blanket 214 is to receive a thermoplastic print agent 410 from a photoconductor element 402. System 100 includes a rotatably mounted endless cleaning surface 110 to receive thermoplastic print agent 410 from photoconductor element 402. In this example, endless cleaning surface 110 is rotatably mounted and is an endless belt surface as the cleaning surface is wrapped around a cleaning surface belt 602. Rotatably mounted endless cleaning surface 110 is to receive a layer of print agent from blanket 214. After receipt of the layer of thermoplastic print agent 410, endless cleaning surface 110 is to engage with blanket drum 404 to transfer residue from blanket 214 to the layer of thermoplastic print agent 410 on endless cleaning surface 110. Scraper 112 is to then engage with endless cleaning surface 110 and thereby transfer the residue from endless cleaning surface 110 to a collection element 220.

Figure 7:
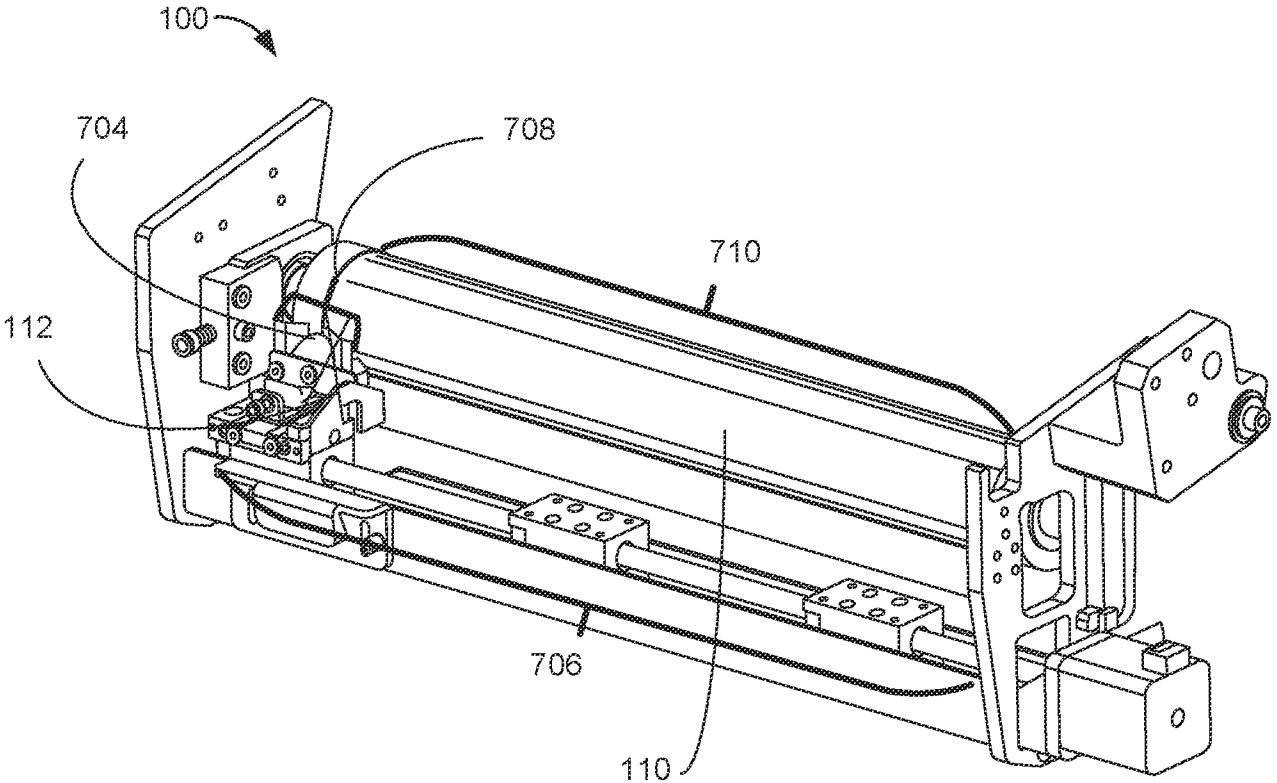
FIG. 7 illustrates an example of a blanket servicing system with a scraper that is movable along a linear track to traverse and engage a width of an endless cleaning surface.
Figure 7:
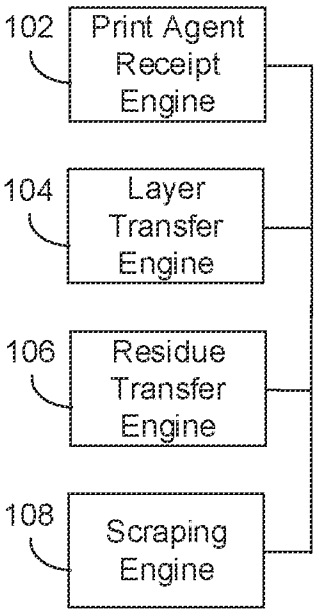

FIG. 7 illustrates another example of the disclosed blanket servicing system 100. In this example, blanket servicing system 100 includes a rotatably mounted endless cleaning surface 110 with a roller surface. Endless cleaning surface 110 is to have a first engagement with a blanket (not visible in FIG. 7, but see 214 FIGS. 4, 5, and 6) to obtain a layer of thermoplastic print agent from the blanket. Subsequently, endless cleaning surface 110 is to have a second engagement with the blanket to receive residue from the blanket onto the layer of thermoplastic print agent.

System 100 includes a scraper 112 to scrape endless cleaning surface 110 to transfer the residue from endless cleaning surface 110 to a collection element (not visible in FIG. 7, but see 220 FIGS. 4, 5, and 6). In the example of FIG. 7, scraper 112 includes a convex surface 704 and is movable along a linear track 706 in a horizontal plane. The convex shape of scraper 112 is to provide rigidity to the scraping surface and the linear track 706 is to enable the use of a scraper with a first width 708 that is less than a second width 710 of the endless cleaning surface 110 to be scraped. This arrangement is designed to, in many circumstances, require less torque than a fixed scraper design. This arrangement is also designed to, in many circumstances, be more forgiving, relative to a fixed scraper setup, when the scraper 112 encounters a markedly uneven surface due to residue buildup on the endless cleaning surface 110.

Figure 8:
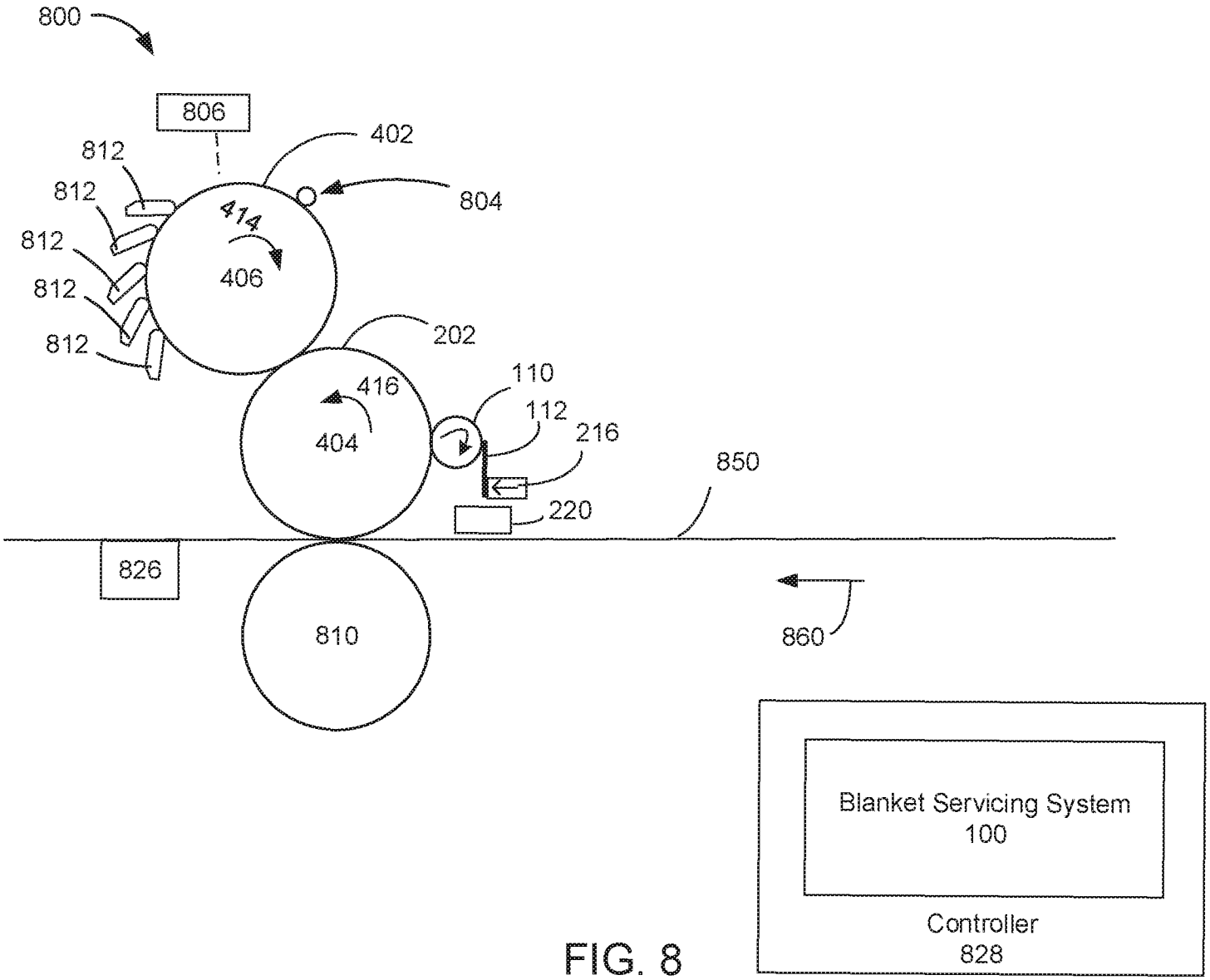
FIG. 8 is a simple schematic diagram illustrating a cross section of a LEP printer implementing a blanket servicing system, according to an example of the principles described herein.

FIG. 8 is a schematic diagram showing a cross section of an example LEP printer 800 implementing the system 100 for servicing blankets utilizing thermoplastic print agent, according to an example of the principles described herein. In an example, the LEP printer 800 may include a photoconductive element 402, a charging element 804, an imaging unit 806, an intermediate transfer member blanket 202, an impression cylinder 810, developer assemblies 812, a first cylindrical drum 406, and a second cylindrical drum 404, According to the example of FIG. 8, a pattern of electrostatic charge is formed on the photoconductive element 402 by rotating a clean, bare segment of the photoconductive element 402 under the charging element 804. The photoconductive element 402 in this example is cylindrical in shape, e.g. is attached to the first cylindrical drum 406, and rotates in a first direction of arrow 414. In other examples, a photoconductive element may planar or part of a belt-driven system.

Charging element 804 may include a charging device, such as a charge roller, corona wire, scorotron, or any other charging device. A uniform static charge is deposited on the photoconductive element 402 by the charging element 804. As the photoconductive element 402 continues to rotate, it passes the imaging unit 806 where one or more laser beams dissipate localized charge in selected portions of the photoconductive element 402 to leave an invisible electrostatic charge pattern ("latent image") that corresponds to the image to be printed. In some examples, the charging element 804 applies a negative charge to the surface of the photoconductive element 402. In other implementations, the charge is a positive charge. The imaging unit 806 then selectively discharges portions of the photoconductive element 402, resulting in local neutralized regions on the photoconductive element 402.

Continuing with the example of FIG. 8, developer assemblies 812 are disposed adjacent to the photoconductive element 402 and may correspond to various print fluid colors such as cyan, magenta, yellow, black, and the like. There may be one developer assembly 812 for each print fluid color. In other examples, e.g., black and white printing, a single developer assembly 812 may be included in LEP printer 800. During printing, the appropriate developer assembly 812 is engaged with the photoconductive element 402. The engaged developer assembly 812 presents a uniform film of print fluid to the photoconductive element 402. The print fluid contains electrically-charged pigment particles which are attracted to the opposing charges on the image areas of the photoconductive element 402. As a result, the photoconductive element 402 has a developed image on its surface, i.e. a pattern of print fluid corresponding with the electrostatic charge pattern (also sometimes referred to as a "separation").

The print fluid is transferred from the photoconductive element 402 to blanket 202. The blanket may be in the form of a blanket attached to the rotatable second cylindrical drum 404. In other examples, the blanket may be in the form of a belt or other transfer system. In this particular example, the photoconductive element 402 and blanket 202 are on drums 406, 404 that rotate relative to one another, such that the color separations are transferred during the relative rotation. In the example of FIG. 8, the blanket 202 rotates in a second direction of arrow 416. The transfer of a developed image from the photoconductive element 402 to the blanket 202 may be known as a "first transfer", which takes place at a point of engagement between the photoconductive element 402 and the blanket 202.

Once the layer of print fluid has been transferred to the blanket 202, it is next transferred to a print substrate. In this example, the print substrate is a web substrate 850 moving along a substrate path in a substrate path direction 860. In other examples, the print substrate may a sheet substrate that travels along a substrate path. This transfer from the blanket 202 to the print substrate may be deemed a "second transfer", which takes place at a point of engagement between the blanket 202 and the print substrate. The impression cylinder 810 can both mechanically compress the print substrate into contact with the blanket 202 and also help feed the print substrate. In examples, the print substrate may be a conductive or a non-conductive print substrate, including, but not limited to, paper, cardboard, sheets of metal, metal-coated paper, or metal-coated cardboard. In examples, the print substrate with a printed image may be moved to a position to be scanned by an inline color measurement device 826, such as a spectrometer or densimeter, to generate optical density and/or background level data.

Controller 828 refers generally to any combination of hardware and software that is to control part, or all, of the LEP printer 800 print process. In examples, the controller 828 can control the voltage level applied by a voltage source, e.g., a power supply, to one or more of the developer assemblies 812, the blanket 202, a drying unit, and other components of LEP printer 800. In this example controller 828 includes system 100 for servicing blankets utilizing thermoplastic print agent that is discussed in detail with respect to FIGS. 1-4 herein. In particular, in this example system 100 includes a rotatably mounted endless cleaning surface 110. Endless cleaning surface 110 is to have a first engagement with blanket 202 to obtain a layer of thermoplastic print agent from blanket 202. Endless cleaning surface 110 is to have a second engagement with blanket 202 to receive residue from the blanket 202 onto the layer of thermoplastic print agent. Scraper 112 is to scrape endless cleaning surface 110 to transfer the residue from the endless cleaning surface 110 to a collection element 220. In this example biasing device 216 includes compression spring to bias scraper 112 against endless cleaning surface 110 with a force control determined in consideration of a sensor-observed smoothness of endless cleaning surface 110.

Figure 9:
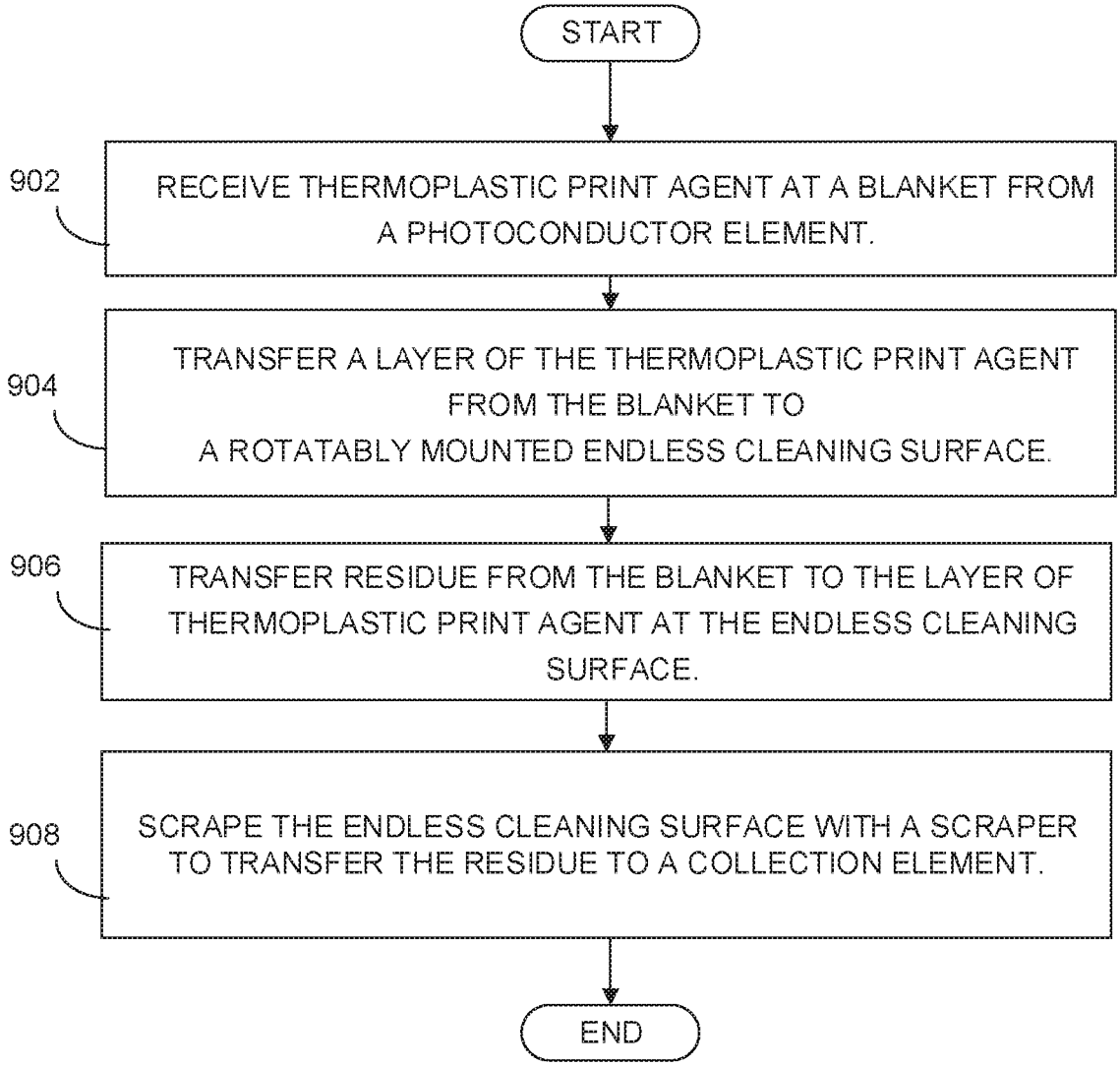
FIG. 9 is a flow diagram depicting an example implementation of a method for servicing a blanket utilizing thermoplastic print agent.

FIG. 9 is a flow diagram of implementation of a method for servicing blankets utilizing thermoplastic print agent during printing. In discussing FIG. 9, reference may be made to the components depicted in FIGS. 1, 2 and 3. Such reference is made to provide contextual examples and not to limit the manner in which the method depicted by FIG. 9 may be implemented. Thermoplastic print agent is received at a blanket from a photoconductor element (block 902). Referring back to FIGS. 1, 2, and 3, print agent receipt engine 110 (FIGS. 1 and 2) or print agent receipt module 310 (FIG. 3), when executed by processing resource 340, may be responsible for implementing block 902.

A layer of the thermoplastic print agent is transferred from the blanket to a rotatably mounted endless cleaning surface (block 904). Referring back to FIGS. 1, 2, and 3, layer transfer engine 104 (FIGS. 1 and 2) or layer transfer module 304 (FIG. 3), when executed by processing resource 340, may be responsible for implementing block 904.

Residue is transferred from the blanket to the layer of thermoplastic print agent at the endless cleaning surface (block 906). Referring back to FIGS. 1, 2, and 3, residue transfer engine 106 (FIGS. 1 and 2) or residue transfer module 306 (FIG. 3), when executed by processing resource 340, may be responsible for implementing block 906.

The endless cleaning surface is scraped with a scraper to transfer the residue to a collection element (block 908). Referring back to FIGS. 1, 2, and 3, scraping engine 108 (FIGS. 1 and 2) or scraping module 308 (FIG. 3), when executed by processing resource 340, may be responsible for implementing block 908.

FIGS. 1-9 aid in depicting the architecture, functionality, and operation of various examples. In particular, FIGS. 1-8 depict various physical and logical components. Various components are defined at least in part as programs or programming. Each such component, portion thereof, or various combinations thereof may represent in whole or in part a module, segment, or portion of code that comprises executable instructions to implement any specified logical function(s). Each component or various combinations thereof may represent a circuit or a number of interconnected circuits to implement the specified logical function (s). Examples can be realized in a memory resource for use by or in connection with a processing resource. A "processing resource" is an instruction execution system such as a computer/processor based system or an ASIC (Application Specific Integrated Circuit) or other system that can fetch or obtain instructions and data from computer-readable media and execute the instructions contained therein. A "memory resource" is a non-transitory storage media that can contain, store, or maintain programs and data for use by or in connection with the instruction execution system. The term "non-transitory" is used only to clarify that the term media, as used herein, does not encompass a signal. Thus, the memory resource can comprise a physical media such as, for example, electronic, magnetic, optical, electromagnetic, or semiconductor media. More specific examples of suitable computer-readable media include, but are not limited to, hard drives, solid state drives, random access memory (RAM), read-only memory (ROM), erasable programmable read-only memory (EPROM), flash drives, and portable compact discs.

Although the flow diagram of FIG. 9 shows specific orders of execution, the order of execution may differ from that which is depicted. For example, the order of execution of two or more blocks or arrows may be scrambled relative to the order shown. Also, two or more blocks shown in succession may be executed concurrently or with partial concurrence. Such variations are within the scope of the present disclosure.

It is appreciated that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein. All of the features disclosed in this specification (including any accompanying claims, abstract and drawings), and/or all of the blocks or stages of any method or process so disclosed, may be combined in any combination, except combinations where at least some of such features, blocks and/or stages are mutually exclusive. The terms "first", "second", "third" and so on in the claims merely distinguish different elements and, unless otherwise stated, are not to be specifically associated with a particular order or particular numbering of elements in the disclosure.

What is claimed is:

1. A blanket servicing system comprising:

a blanket to receive a thermoplastic print agent from a photoconductor element;

a rotatably mounted endless cleaning surface, to receive a layer of thermoplastic print agent from the blanket, wherein the endless cleaning surface is to engage with the blanket to transfer residue from the blanket to the layer of thermoplastic print agent on the endless cleaning surface; and a scraper, to engage with the endless cleaning surface and transfer the residue from the endless cleaning surface to a collection element.

2. The blanket servicing system of claim 1, wherein the endless cleaning surface includes one from the set of a roller surface and a belt surface.

3. The blanket servicing system of claim 1, further comprising a heater to heat the endless cleaning surface; and wherein the scraper is to engage with the endless cleaning surface while the endless cleaning surface is being heated.

4. The blanket servicing system of claim 3, wherein the heater is used to heat the endless cleaning surface as the endless cleaning surface receives the layer of thermoplastic print agent from the blanket.

5. The blanket servicing system of claim 1, wherein the thermoplastic print agent obtained by the endless cleaning surface includes thermoplastic print agent received by the blanket from a photoconductor and is thermoplastic print agent that has not encountered a substrate.

6. The blanket servicing system of claim 1, further comprising a biasing device to bias the scraper against the endless cleaning surface.

7. The blanket servicing system of claim 6, further comprising:

a variance recording engine to utilize a sensor to record an observed variance in thickness and/or density of the endless cleaning surface;

a determination engine to determine a biasing force with which the scraper is to be biased towards the endless cleaning surface in view of the observed variance; and an implementation engine to adjust the biasing device to exert the determined biasing force towards the endless cleaning surface.

8. The blanket servicing system of claim 1, wherein the scraper is to scrape the endless cleaning surface concurrent with the endless cleaning surface cleaning the blanket.

9. The blanket servicing system of claim 8, wherein the scraper is to scrape the endless cleaning surface concurrent with the blanket being utilized in a printing operation.

10. The blanket servicing system of claim 1, wherein the scraper is movable along a linear track to traverse a width of the endless cleaning surface.

11. The blanket servicing system of claim 1, wherein the collection element includes a heater to heat the residue to a melting point within the collection element, and a mold to collect melted residue and allow the melted residue to cool to transform into a hardened state.

12. The blanket servicing system of claim 1, further comprising second collection element, and a screw to engage with the residue in the first collection element to chop the residue into pieces and cause the pieces to accumulate in the second collection element.

13. A method, comprising:

receiving thermoplastic print agent at a blanket from a photoconductor element;

transferring a layer of the thermoplastic print agent from the blanket to a rotatably mounted endless cleaning surface;

transferring residue from the blanket to the layer of thermoplastic print agent at the endless cleaning surface; and scraping the endless cleaning surface with a scraper to transfer the residue to a collection element.

14. A blanket servicing system, comprising:

a rotatably mounted endless cleaning surface, to have a first engagement with a blanket to obtain a layer of thermoplastic print agent from the blanket, and to have a second engagement with the blanket to receive residue from the blanket onto the layer of thermoplastic print agent; and a scraper, to scrape the endless cleaning surface to transfer the residue from the endless cleaning surface to a collection element.

15. The blanket servicing system of claim 14, further comprising a heater;

wherein the heater is to heat the endless cleaning surface as the endless cleaning surface receives the layer of thermoplastic print agent from the blanket; and wherein the heater is to heat the endless cleaning surface as the scraper is scraping the endless cleaning surface.

* * * * *